US008441893B2

(12) United States Patent
Stephens Stauffer et al.

(10) Patent No.: US 8,441,893 B2
(45) Date of Patent: May 14, 2013

(54) SYSTEM AND METHOD FOR INDICATING ELAPSED TIME

(75) Inventors: Deborah Joy Stephens Stauffer, Cupertino, CA (US); Kathleen McCann Whitehurst, St. Helena, CA (US)

(73) Assignee: Double U Products, Inc., Cupertino, CA (US)

( * ) Notice: Subject to any disclaimer, the term of this patent is extended or adjusted under 35 U.S.C. 154(b) by 876 days.

(21) Appl. No.: 11/512,580

(22) Filed: Aug. 29, 2006

(65) Prior Publication Data

US 2007/0091726 A1 Apr. 26, 2007

Related U.S. Application Data

(63) Continuation of application No. 11/256,034, filed on Oct. 21, 2005, now abandoned.

(60) Provisional application No. 60/785,644, filed on Mar. 24, 2006.

(51) Int. Cl.
*G04F 8/00* (2006.01)
*G04F 1/00* (2006.01)
*G04B 47/00* (2006.01)

(52) U.S. Cl.
USPC ..... 368/107; 368/10; 368/110

(58) Field of Classification Search ..... 368/10, 368/69, 107–110, 187, 188, 82, 113, 223, 368/239; 206/459.1, 459.5; 215/230; 221/2, 221/3, 15
See application file for complete search history.

(56) References Cited

U.S. PATENT DOCUMENTS

| | | | | | |
|---|---|---|---|---|---|
| D238,055 | S | | 12/1975 | Seshimo | |
| 4,005,571 | A | * | 2/1977 | Wolff | 368/108 |
| D245,232 | S | | 8/1977 | Quirin | |
| D245,582 | S | | 8/1977 | Mox | |
| 4,059,955 | A | * | 11/1977 | Prak | 368/188 |
| 4,089,156 | A | * | 5/1978 | Kashio | 368/112 |
| 4,092,822 | A | * | 6/1978 | Droz et al. | 368/187 |
| 4,142,361 | A | * | 3/1979 | Kimura | 368/251 |
| 4,184,319 | A | | 1/1980 | Kumata | |
| 4,361,408 | A | * | 11/1982 | Wirtschafter | 368/10 |
| D270,244 | S | | 8/1983 | McCormick | |
| 4,419,016 | A | * | 12/1983 | Zoltan | 368/10 |
| D276,219 | S | | 11/1984 | Mox | |
| D276,416 | S | | 11/1984 | Mox | |

(Continued)

OTHER PUBLICATIONS

United States Patent and Trademark Office Non-Final Office Action, Notice of References Cited for U.S. Appl. No. 11/256,034, Jun. 5, 2006 (date mailed), 5 pages.

*Primary Examiner* — Vit W Miska
(74) *Attorney, Agent, or Firm* — Carr & Ferrell LLP

(57) ABSTRACT

An electronic timing device is disclosed for simply and easily indicating elapsed time since a food container was opened. The electronic timing device can be directly attached to the food container and can be activated when first opening the food container. Activation occurs via a simple one-button-press operation. Thereafter, the electronic timing device displays elapsed time in days. Additionally, via a further one-button-press operation, the electronic timing device can display elapsed time in hours within the current day. Thereafter, viewing the display readily indicates the elapsed time since the food container was first opened. The electronic timing device can be reused by directly attaching it to another food container and re-activating the electronic timing device. The electronic timing device can be used with any container or to indicate elapsed time of any event having occurred.

33 Claims, 6 Drawing Sheets

U.S. PATENT DOCUMENTS

| | | | | | |
|---|---|---|---|---|---|
| D282,446 | S | | 2/1986 | Gremonprez et al. | |
| D284,358 | S | | 6/1986 | Chan | |
| 4,620,555 | A | | 11/1986 | Schwartz | |
| 4,630,935 | A | * | 12/1986 | Zettek | 368/41 |
| 4,849,948 | A | | 7/1989 | Davis et al. | |
| D303,767 | S | | 10/1989 | Baird et al. | |
| 4,939,795 | A | | 7/1990 | Iding et al. | |
| 5,058,085 | A | * | 10/1991 | Lawler | 368/28 |
| 5,170,380 | A | * | 12/1992 | Howard et al. | 368/10 |
| D334,347 | S | | 3/1993 | White | |
| 5,229,981 | A | | 7/1993 | Maschi | |
| 5,233,571 | A | | 8/1993 | Wirtschafter | |
| D351,797 | S | | 10/1994 | White | |
| D364,101 | S | | 11/1995 | Bradley | |
| 5,555,223 | A | | 9/1996 | Barainsky | |
| D383,983 | S | | 9/1997 | Steinhagen et al. | |
| 5,751,660 | A | * | 5/1998 | Chappell | 368/10 |
| 5,761,157 | A | | 6/1998 | Takeda et al. | |
| 5,802,015 | A | | 9/1998 | Rothschild et al. | |
| D401,526 | S | | 11/1998 | Stunder | |
| D404,317 | S | | 1/1999 | Cameron | |
| 5,953,288 | A | * | 9/1999 | Chappell | 368/10 |
| 6,069,848 | A | * | 5/2000 | McDonald et al. | 368/107 |
| 6,158,613 | A | | 12/2000 | Novosel et al. | |
| 6,317,390 | B1 | | 11/2001 | Cardoza | |
| 6,345,015 | B1 | * | 2/2002 | Coulson | 368/10 |
| D471,116 | S | | 3/2003 | Suzuki | |
| 6,588,593 | B2 | * | 7/2003 | Woskoski | 206/459.1 |
| 6,633,796 | B1 | | 10/2003 | Pool et al. | |
| 6,707,763 | B2 | | 3/2004 | Osberg et al. | |
| 6,817,192 | B2 | | 11/2004 | Ector, Jr. et al. | |
| 6,845,064 | B2 | | 1/2005 | Hildebrandt | |
| 7,061,832 | B1 | * | 6/2006 | Lansing | 368/10 |
| D525,538 | S | | 7/2006 | Oas | |
| 7,081,807 | B2 | | 7/2006 | Lai | |
| 7,236,428 | B1 | * | 6/2007 | Morse | 368/10 |
| 7,502,281 | B2 | * | 3/2009 | Rund | 368/82 |
| 2001/0036129 | A1 | * | 11/2001 | Carr | 368/109 |
| 2002/0180591 | A1 | | 12/2002 | Berstling et al. | |
| 2003/0071456 | A1 | | 4/2003 | Gervais | |
| 2004/0008589 | A1 | * | 1/2004 | McMillan et al. | 368/223 |
| 2004/0022132 | A1 | * | 2/2004 | Rund | 368/82 |
| 2005/0121407 | A1 | | 6/2005 | Hildebrandt | |
| 2005/0128879 | A1 | * | 6/2005 | Sanford et al. | 368/109 |
| 2005/0135196 | A1 | * | 6/2005 | Rund | 368/108 |
| 2006/0181961 | A1 | * | 8/2006 | Hobkirk | 368/10 |
| 2006/0256662 | A1 | * | 11/2006 | Martin | 368/10 |

* cited by examiner

SYSTEM AND METHOD FOR INDICATING ELAPSED TIME

CROSS-REFERENCE TO RELATED APPLICATIONS

This application claims the benefit of U.S. Provisional Patent Application No. 60/785,644 filed on Mar. 24, 2006 and entitled "System and Method for Indicating Elapsed Time." The present application is a continuation and also claims the benefit of U.S. Non-Provisional patent application Ser. No. 11/256,034 filed on Oct. 21, 2005 and entitled "Digital Food Expiration Date Counter." Each of the applications listed above are incorporated by reference herein.

BACKGROUND OF THE INVENTION

1. Field of the Invention

The present invention relates generally to using an electronic timer to measure elapsed time and more particularly to measuring elapsed time since opening a container as may contain food or other perishable items.

2. Description of the Prior Art

In the modern, fast-paced world, it has become increasingly difficult to remember all of the things that may once have been easy. While modern technology has touted making our lives easier by providing more leisure time, in many respects all it has done is push everyone to perform even more tasks in the same amount of time. This has led to an even greater need for time and task management techniques in order to keep up with the ever greater demands placed upon us all.

Large, seemingly important tasks have been addressed by, for example, having multiple individuals involved to ensure nothing is forgotten or overlooked or by utilizing electronic calendars with electronic reminders. By contrast, certain other tasks, however, are seemingly too simple to need time or task management assistance. As a result, these simpler tasks oftentimes place the greatest burdens on us by requiring us to simply remember them on our own.

Examples of such tasks include recalling when the last time a plant was watered. Another is determining whether an opened food container contains food still edible or, having expired, should be discarded. Some food containers such as milk and eggs provide an expiration date printed directly on the container. This expiration date is commonly referred to as a "use by" date. All the consumer has to do is compare the printed "use by" date to the calendar date to know whether the food may still be edible.

However, many other food containers do not include a printed expiration date and instead simply include a printed statement that the food will expire a certain number of days after first opening the container. This requires the consumer to have to recall when the container was first opened else risk consuming food that is no longer healthy to eat.

One prior approach to this problem is called timestrip smart labels by Timestrip Limited of the United Kingdom. A timestrip smart label is a single-use, disposable label which can be used on a food container. Before placing a timestrip smart label on a food container, a bubble at the back is first squeezed to activate the timestrip smart label. Activating the timestrip smart label causes a tinted liquid to begin migrating via capillary action through a porous material to visually indicate elapsed time.

Note, however, that there are a number of limitations to and questions about this prior approach. The timestrip smart label cannot be reset or reused after having first been activated. As such, a consumer can only use the timestrip smart label one time before having to discard it and obtain a new, unused timestrip smart label. Also, the timestrip smart label, due to its construction and method of operation, is limited to indicating a single, predetermined elapsed time period of, for example, three days. As such, the timestrip smart label has no ability to indicate an elapsed time any greater than its single, predetermined time period which may or may not correspond to the period of time a consumer needs to measure for a particular food container. Further, some consumers may be concerned about placing a timestrip smart label on a food container for fear of, for example, contamination due to the unknown chemicals and materials used therein, particularly should leakage of the chemicals occur. Additionally, some consumers may question whether a timestrip smart label will properly operate in the cold environs of a refrigerator or freezer.

Another prior approach involves a two-piece timer which, through use of the multiple pieces, can be attached to such items as food containers. In this approach, one piece determines the elapsed time and the other piece physically attaches to the food container via an adhesive strip. The first piece has a magnetic backing and the other piece is made of metal so the two pieces are attracted to each other via magnetic attraction.

The stated benefit of this two-piece timer approach is the ability to separate the two pieces thus leaving the second adhesive metal piece attached to the food container while being cleaned in a dishwasher thus leaving the first elapsed time piece safely dry for later reuse. Of course, this stated benefit has little value when the desire is not reuse of the same food container but, instead, to track elapsed time of a newly opened food container. Further, if a consumer accidentally knocks a first elapsed time piece off of a second adhesive metal piece attached to a food container, raises the possibility of the consumer becoming confused about which of multiple containers the first elapsed time piece belongs, particularly when the multiple containers each have a second adhesive metal piece attached thereto.

A further difficulty with this prior approach is its complicated display. The display of the two-piece timer simultaneous displays both days and hours of elapsed time. Simultaneously displaying this much information requires either a physically large display or small display numerals, neither of which is desirable in a simple, user friendly device.

Other approaches involve manually operated and/or mechanical time indicators, chemically activated food spoilage indicators, etc., as described and referenced in the background section of U.S. Pat. No. 6,817,192.

What is needed, therefore, is a simple, user friendly way to easily determine how much time has elapsed since opening a food container in order to know whether the food is still edible.

SUMMARY

An exemplary electronic timing device is provided comprising an electronic timer, a switch for activating the electronic timer, a display for showing elapsed time as determined by the electronic timer, and a suction cup for directly attaching the electronic timing device to a container.

A further exemplary electronic timing device is provided comprising an electronic timer, a switch for activating the electronic timer, a display for showing elapsed time as determined by the electronic timer, and a magnet for directly attaching the electronic timing device to a metallic portion of a container.

A still further exemplary electronic timing device is provided for indicating elapsed time after opening a food container, the electronic timing device comprising a housing, an electronic timer for measuring elapsed time, the electronic timer located within the housing, a switch for activating the electronic timing mechanism to begin measuring elapsed time, the switch located inside the housing, a button for triggering the switch, the button accessible from outside the housing, a display for showing the elapsed time, the display visible from outside the housing, and a suction cup for directly attaching the electronic timing device to the food container, the suction cup located on the bottom of the housing unit.

An exemplary method of determining elapsed time since opening a container is also provided, the method comprising directly attaching an electronic timing device to a container, opening the container, activating a timing function of the electronic timing device, counting elapsed time since activating the timing function of the electronic timing device, and displaying the counted elapsed time in days.

A further exemplary method of determining elapsed time since opening a container is provided, the method comprising directly attaching an electronic timing device to a container, opening the container, pressing a button on the electronic timing device for a predetermined time to activate a timing function of the electronic timing device thereby causing the timing device to start counting elapsed time, and reading a display of the counted elapsed time in days.

DETAILED DESCRIPTION OF THE INVENTION

Figure 1:
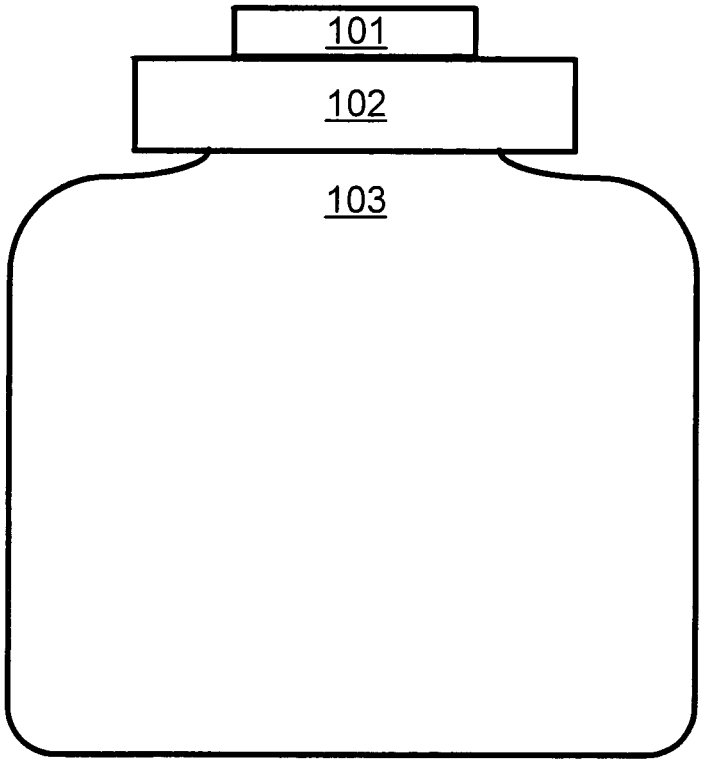
FIG. 1 depicts a food container with lid to which an exemplary electronic timing device is attached.

An electronic timing device is provided for indicating the amount of time that has elapsed since opening a sealed food container. The electronic timing device is placed on the food container and is activated when the food container is first opened. Activating the electronic timing device causes the electronic timing device to start a timing function and thereafter display the elapsed time. By viewing the displayed elapsed time, the user can more readily determine the condition of the contents of the food container.

An exemplary application of the electronic timing device is with a baby food jar. A baby food jar typically has a printed statement about the number of days the food is still safe to eat after first being opened. Placing and activating the electronic timing device on the baby food jar when first opened provides a ready indication of how much time has elapsed since the baby food jar was first opened. Comparing this elapsed time indication to the printed statement thus makes it easy to determine whether the baby food may still be safe to eat.

Uses of the electronic timing device include, but are not limited to, tracking the number of days that have elapsed after a sealed container for a perishable item has been opened or after a repeated or particular action has occurred. For example, the container may contain any perishable item or may contain any item that degrades, degenerates or changes to an undesirable state with the passage of time. Another exemplary use of the electronic timing device may be to indicate elapsed time since a repeated activity last occurred, such as watering a plant or taking a medication. Still another exemplary use of the electronic timing device is simply as a visual indicator of elapsed time which indicator may be a useful reminder to the user to perform or check some action or item such as replacing an item which over time wears out or becomes less effective than desired (e.g., an air cleaner or filter).

The electronic timing device is small enough so that it can be affixed to any of a variety of different size containers or lids for containers or to be conveniently placed in useful environments without interfering with the function of the container or impede regular activities in the environment. Likewise, the electronic timing device is large enough so that the elapsed time display is easily viewable.

It will be understood that attaching the electronic timing device to a container refers to attaching the electronic timing device directly to the container itself, attaching the electronic timing device to the lid or top of the container, attaching the electronic timing device to something associated with the container such as a label affixed to the container, or any combination thereof.

The electronic timing device can be attached to a container in a variety of different ways. One embodiment of the electronic timing device includes a magnet for attaching the electronic timing device to a metallic portion of a container or to a metal lid for the container. Another embodiment of the electronic timing device includes a suction cup for attaching the electronic timing device to the lid or to the container itself as is particularly effective in the case of the container being made out of glass. Still another embodiment of the electronic timing device includes a Velcro strip which attaches to a complimentary Velcro strip on the lid or container. Yet another embodiment of the electronic timing device includes an elastic strap/band which may be placed around the container, around the rim of a lid, or around a stick which may be inserted in the dirt of a container which may, for example, contain a plant. A still further embodiment includes a recess in the electronic timing device adapted to receive a stick, rod or other protrusion which itself may be embedded into or be part of, for example, a plant container. Generally, each of these embodiments provides the ability for the electronic timing device to easily be removed from the container and reused with the same or different container as desired. An alternative embodiment of the electronic timing device includes an adhesive pad (e.g., double-sided tape) which sticks to the container or lid. This embodiment may still provide the ability for removal and reuse depending upon the stickiness of the adhesive and/or the replaceability of the adhesive pad itself.

FIG. 1 depicts an exemplary container 103 having a lid 102 to which an electronic timing device 101 has been attached. Container 103 and lid 102 can each be made of any material such as glass, metal, plastic, Styrofoam, cardboard, etc., and may be of any shape such as round, cylindrical, rectangular, etc. It is understood that container 103 and lid 102 may be of the same or dissimilar materials and/or shapes.

Container 103 may be a food container containing food items which become perishable or spoiled over time after lid 102 has been removed from container 103. Electronic timing device 101, having been placed on lid 102 and activated when lid 102 was first removed, counts up the elapsed time to thus indicate when the food contained therein may have perished or become spoiled. A consumer need merely compare the indicated elapsed time against an amount of time specified on container 103 or lid 102 or against a known amount of time to make this determination.

Similarly, container 103 may be a container for holding chemicals or other items which may become ineffective or unusable after a period of time such as may occur after lid 102 has been removed from container 103 which exposes the chemicals or other items to the ambient air. Again, electronic timing device 101, having been placed on lid 102 and activated either when lid 102 was first removed or when the chemicals or other items were prepared or placed in container 103, counts up the elapsed time to thus indicate when the chemicals or other items may have become ineffective or unusable. As such, a user of the chemicals or other items need merely compare the indicated elapsed time against an amount of time specified on container 103 or lid 102 or against a known amount of time before the chemicals or other items become ineffective or unusable.

Figure 2:
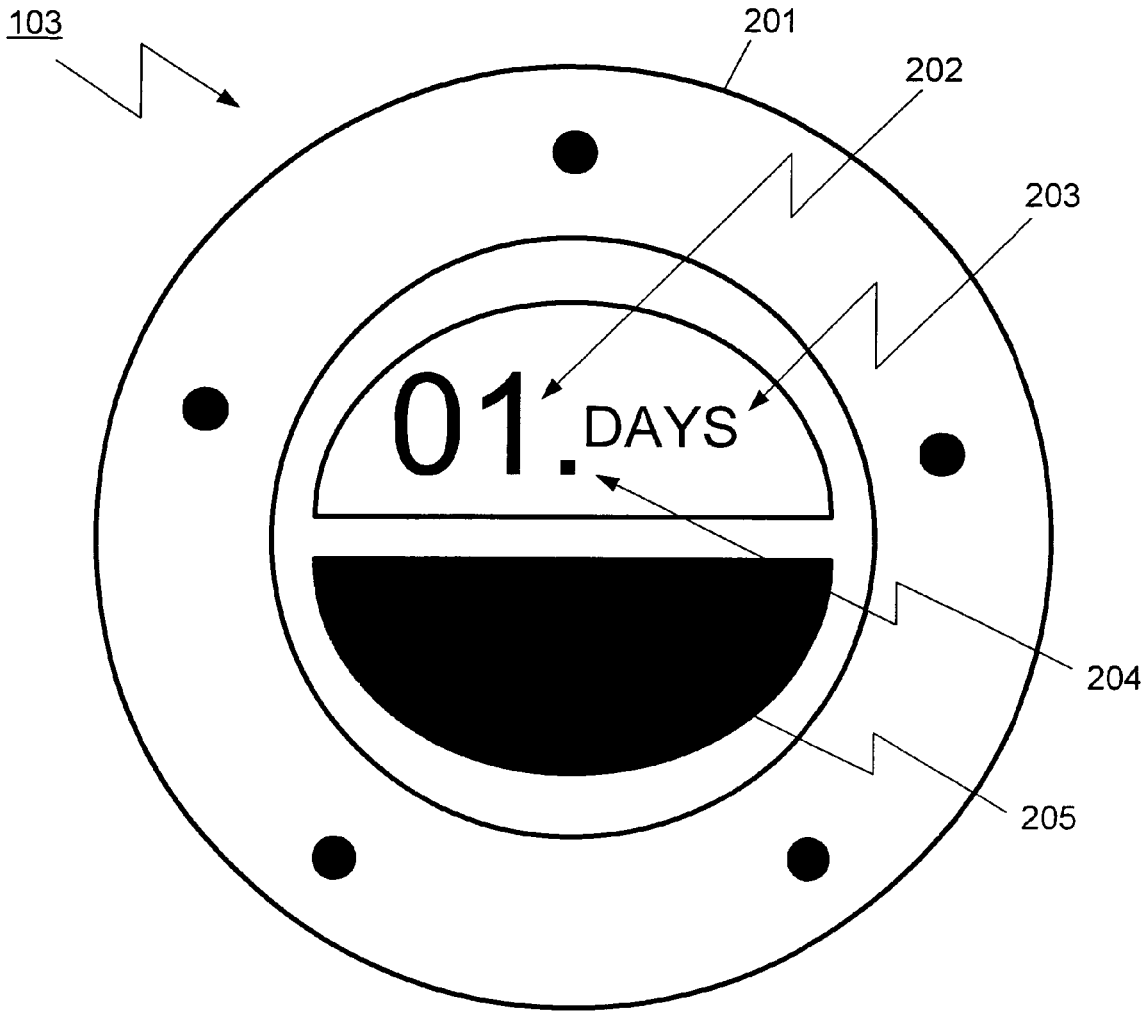
FIG. 2 is a top view of one embodiment of an electronic timing device.

FIG. 2 depicts a top view of one embodiment of electronic timing device 101. In this embodiment, electronic timing device 101 has a circular shaped housing 201 which may be made of one or more materials such as plastic (e.g., Acrylonitrile Butadiene Styrene (abs), nylon, polystyrene, Lucite, etc.), ceramic, or metal (e.g., aluminum, stainless steel, etc.). In other embodiments of electronic timing device 101, housing 201 may be formed in the shape of a square, rectangle, oval, triangle, octagon, star or other ornamental shape or design(s) (e.g., iconic, shape of publicly known character or food item, company or product logo or design, etc.).

In this embodiment, the electronic timing device 101 also has an elapsed time display 202 containing a two-digit digital display for showing the amount of time that has elapsed since activation of the timing function of electronic timing device 101. In normal operation, the two-digit digital display of elapsed time display 202 simply shows this amount of elapsed time in days rather than in a more precise display as might be seen when using, for example, a stopwatch to measure elapsed time. To further aid the user in interpreting the two-digit elapsed time display 202, electronic timing device 101 also has a time scale display 203 which, in normal operation, shows the word "DAYS" to indicate that the number shown in elapsed time display 202 is a measure of time in days.

In another mode of operation described further herein, elapsed time display 202 shows the amount of elapsed time in hours within the current day and, while in that mode of operation, "HOURS" is displayed (not shown) in time scale display 203 to thus aid the user in properly interpreting the two-digit elapsed time display 202. It will be understood that the hours display is not intended to indicate the current time of day, but rather, the number of elapsed hours within each 24 hour period since activation of the electronic timing device.

To further aid the user an operating indicator 204 is included in some embodiments of electronic timing device 101. Operating indicator 204 shows a blinking cursor or other visual indication that the electronic timing device 101 is currently operating. Conversely, if operating indicator 204 shows a steady-state, non-blinking cursor or no visual indication, this is an indication that electronic timing device 101 is not currently operating and may need, for example, a replacement battery installed.

It will be understood that elapsed time display 202, time scale display 203 and operating indicator 204 may be implemented as one or more of various types of displays such as liquid crystal (LCD) or light emitting diode (LED), for example, and the number of display characters and/or words displayed can vary as desired to provide a greater time amount or resolution (in the case of elapsed time display 202), a different time scale or language (in the case of time scale display 203), or to provide a different visual indication of operating condition (in the case of operating indicator 204). Further, elapsed time display 202, time scale display 203 and operating indicator 204 may be formed from a single, integrated display technology or may be implemented using physically separate displays of the same or different type.

Electronic timing device 101 has a button 205. Activation of the timing function of electronic timing device 101 occurs when button 205 is pressed. Button 205 triggers a switch (not shown) which in turn activates an electronic timer (also not shown) inside electronic timing device 101. In one embodiment, button 205 must be pressed and held for a period of time, e.g., five seconds, before activation of the timing function of the electronic timing device 101 is triggered to avoid inadvertent activation while handling electronic timing device 101 and/or container 103 and/or lid 102 (FIG. 1). In one embodiment, activation of the timing function of electronic timing device 101 merely causes the timer to be reset to an initial condition so that electronic timing device 101 can begin counting up the elapsed time from a beginning state. In other words, in this embodiment, the timing function of electronic timing device 101 is always counting up elapsed time and activation merely causes the timing function to return to a zero elapsed time condition and continue counting up elapsed time from that point.

Figure 3A:
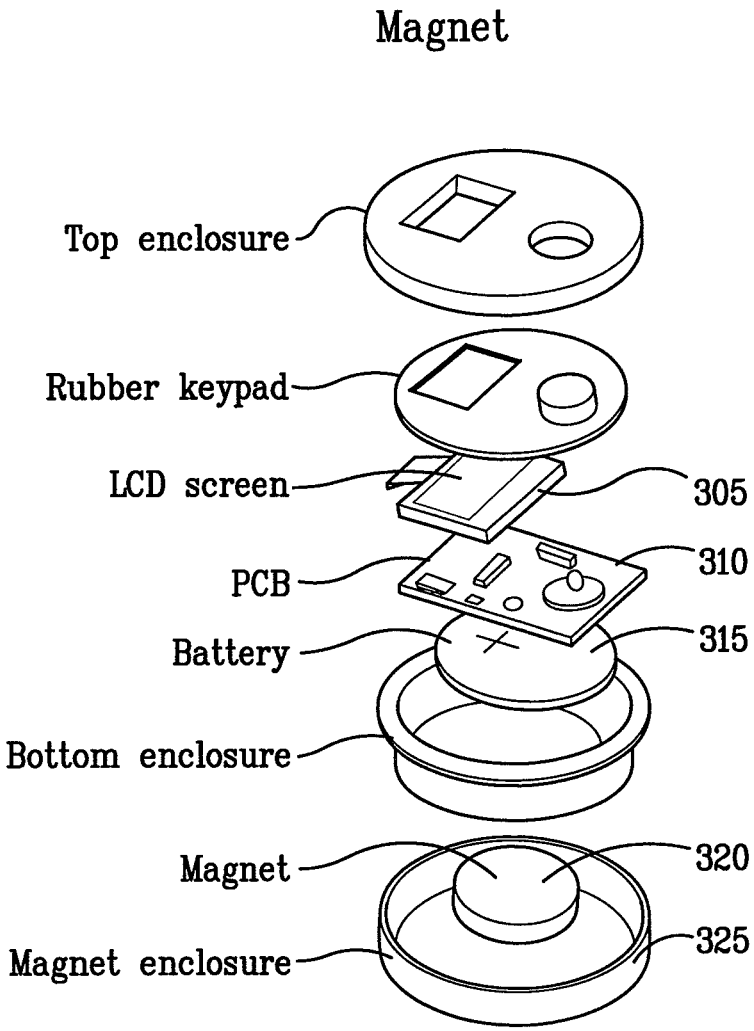
FIG. 3*a* is an exploded view of one embodiment of an electronic timing device with a magnetic attachment.
Figure 3B:
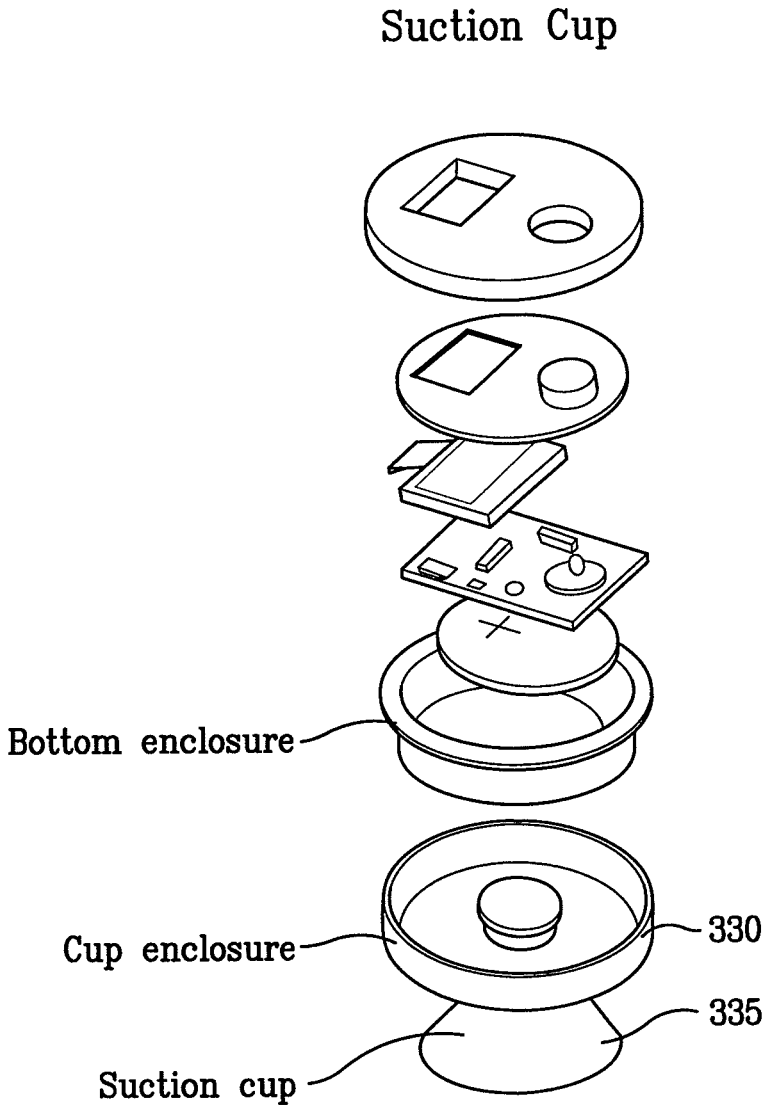
FIG. 3*b* is an exploded view of another embodiment of an electronic timing device with a suction cup attachment.
Figure 3C:
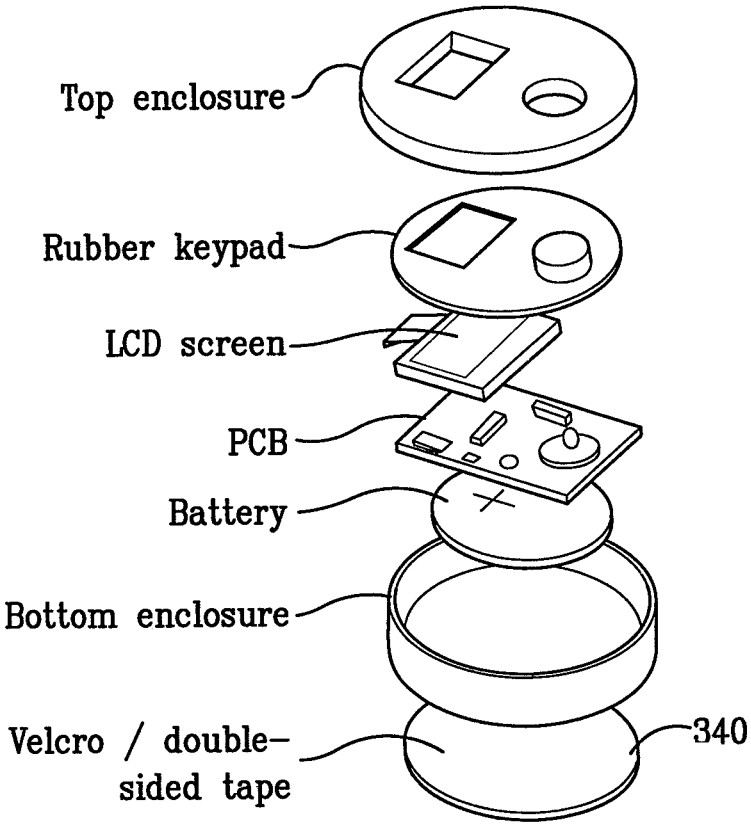
FIG. 3*c* is an exploded view of one embodiment of an electronic timing device with a Velcro or double-sided adhesive attachment.

FIGS. 3*a*, 3*b* and 3*c* show exploded views of various embodiments of electronic timing device 101 having alternative forms of attachment. Referring now to FIG. 3*a*, various pieces of electronic timing device 101 can be seen in the exploded view. In particular, LCD screen 305 contains elapsed time display 202, time scale display 203 and operating indicator 204. Further, printed circuit board (PCB) 310 contains other associated electronics and circuitry as are known in the art to be capable of performing the operations of electronic timing device 101 as described herein. Such operations include but are not limited to the timing function of an electronic timer for electronic timing device 101 and the activation switch triggered by button 205 of FIG. 2.

In this embodiment, a battery 315 is included to power electronic timing device 101. Battery 315 may be a replaceable item or may be a permanent fixture in which case electronic timing device 101 may be discarded when battery 315 runs out of power. Alternatively, battery 315 may be rechargeable by a variety of known mechanisms including through an electrical connection or through an optical sensor (not shown) on the electronic timing device 101 that converts received photonic energy into electrical energy which is supplied to the battery 315.

Also in this embodiment, a magnet 320 is shown for attaching electronic timing device 101 to a container as desired. Magnet 320 is shown contained within a magnet enclosure 325 attached to a housing (e.g., housing 201 of FIG. 2) of electronic timing device 101 but may instead be adhesively attached to an external surface of electronic timing device 101.

The counter has a backing that can be manipulated to expose a variety of connections to containers. The connections are reusable on multiple and different containers and do not require refillable parts. The counter comes equipped with connections including things like a magnet, suction cup, elastic band, stick, clip or adhesive. The counter is designed to affix to a variety of surfaces such as metal, plastic or cardboard or to attach to items through elastic tension or a clip. It can also be positioned within an environment such as placed on a stick dug into the dirt of a household plant container.

Referring now to FIG. 3*b*, an alternative embodiment of electronic timing device 101 is shown whereby magnet 320 is replaced by a suction cup 335 for attaching electronic timing device 101 to a container as desired. It is understood that alterations to electronic timing device 101 to accommodate suction cup 335, such as providing an opening in a cup enclosure 330 attached to a housing (e.g., housing 201 of FIG. 2) of electronic timing device 101, are within the ordinary skill in the art. In other respects, the elements of the embodiment of electronic timing device 101 shown in FIG. 3*b* correspond to the elements of the embodiment of electronic timing device 101 shown in FIG. 3*a*.

Referring now to FIG. 3*c*, a further alternative embodiment of electronic timing device 101 is shown whereby magnet 320 or suction cup 335 is replaced by a Velcro or adhesive tape 340. In this embodiment, the Velcro or adhesive tape 340 is attached directly to the housing (e.g., housing 201 of FIG. 2) of the electronic timing device 101 thus eliminating the magnet enclosure 325 and cup enclosure 330 of FIGS. 3*a* and 3*b* respectively. In other respects, the elements of the embodiment of electronic timing device 101 shown in FIG. 3*c* correspond to the elements of the embodiment of electronic timing device 101 shown in FIGS. 3*a* and 3*b*.

Figure 4:
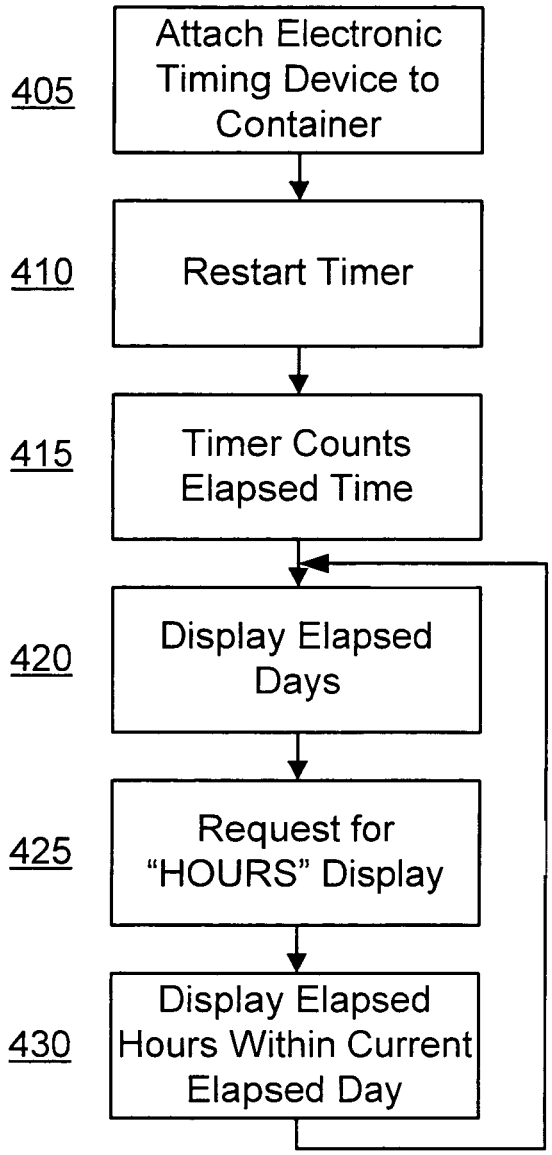
FIG. 4 is a flow chart of the use and operation of electronic timing device 101 according to one or more embodiments.

FIG. 4 is a flow chart of the use and operation of electronic timing device 101 according to one or more embodiments. Use of electronic timing device 101 begins with attaching electronic timing device 101 to a container in step 405. In step 410, pressing button 205 on electronic timing device 101 triggers activation of the timing function of electronic timing device 101. Triggering activation of the timing function of electronic timing device 101 causes the electronic timer of electronic timing device 101 to restart or begin counting up the elapsed time in step 415. As explained elsewhere herein, in some embodiments, the pressing of button 205 must occur for a predetermined period of time, e.g., five seconds, to trigger the activation of the timing function of electronic timing device 101. Note further that step 405 of attaching electronic timing device 101 to a container may occur after step 410 of triggering activation of the timing function rather than before as just described.

Following activation of the timing function of electronic timing device 101, the elapsed time is displayed in elapsed time display 202 along with the corresponding time scale display 203 in step 420.

Without further user activity, this elapsed time display 202 continues until the elapsed time display 202 can no longer fully display the total elapsed time, in which case the elapsed time display 202 would either stop counting or, alternatively, wrap or rollover back to a zero and continue counting. For example, with a two-digit display, elapsed time display 202 would display from "00" days to "99" days and would then stop or, alternatively, wrap or roll the displayed count back to "00" days and continue counting.

Alternatively, the user may press button 205 for a brief period of time, e.g., one second, in step 425. In that case, elapsed time display 202 would display the number of elapsed hours in the current 24 hour period and time scale display 202 would display "HOURS" instead of "DAYS" in step 430. In this way, the user can readily determine not only how many days have elapsed but also how many hours have elapsed within the current 24 hour period should knowing such precision be desirable. Such precision may be helpful in some circumstances in determining the likelihood of food having spoiled or chemicals or other items no longer being effective or useful.

In some embodiments, after the user has briefly pressed button 205 in step 425 and a period of time has passed, elapsed time display 202 once again displays elapsed time in days and time scale display 203 once again displays "DAYS" thus returning to step 420. In alternative embodiments, returning to step 420 would occur after the user has once again briefly pressed button 205.

At any point in the process described in FIG. 4, the user may press button 205 for the predetermined period of time to trigger activation of the timing function of electronic timing device 101. This returns the process to restarting the timing function of electronic timing device 101 in step 410.

In the foregoing specification, the invention is described with reference to specific embodiments thereof, but those skilled in the art will recognize that the invention is not limited thereto. Various features and aspects of the above-described invention may be used individually or jointly. Further, the invention can be utilized in any number of environments and applications beyond those described herein without departing from the broader spirit and scope of the specification. The specification and drawings are, accordingly, to be regarded as illustrative rather than restrictive. It will be recognized that the terms "comprising," "including," and "having," as used herein, are specifically intended to be read as open-ended terms of art.

What is claimed is:

1. An electronic timing device comprising:

an electronic timer;

a switch for activating the electronic timer;

a display for showing elapsed time as determined by the electronic timer, the display comprising an elapsed time component and a time scale component, the elapsed time component configured to display numerically how much time has elapsed since the activation of the electronic timer, the time scale component configured to display by at least a word whether the elapsed time is a measure of time in days elapsed or in hours elapsed;

a button for requesting the display to show the elapsed time in days elapsed or hours elapsed; and a suction cup for directly attaching the electronic timing device to a container.

2. The electronic timing device of claim 1 wherein the display for showing elapsed time alternates between showing days elapsed and hours elapsed.

3. The electronic timing device of claim 2 wherein the display for showing elapsed time is a two-digit numerical elapsed time display and an alphanumeric scale display.

4. An electronic timing device comprising:

an electronic timer;

a switch for activating the electronic timer;

a display for showing elapsed time as determined by the electronic timer, the display comprising an elapsed time component and a time scale component, the elapsed time component configured to display numerically how much time has elapsed since the activation of the electronic timer, the time scale component configured to display by at least a word whether the elapsed time is a measure of time in days elapsed or in hours elapsed;

a button for requesting the display to show the elapsed time in one of days elapsed and hours elapsed; and a magnet for directly attaching the electronic timing device to a metallic portion of a container.

5. The electronic timing device of claim 4 wherein the display for showing elapsed time alternates between showing days elapsed and hours elapsed.

6. The electronic timing device of claim 5 wherein the display for showing elapsed time is a two-digit numerical elapsed time display and an alphanumeric scale display.

7. An electronic timing device for indicating elapsed time after opening a food container, the electronic timing device comprising:

a housing;

an electronic timer for measuring elapsed time, the electronic timer located within the housing;

a switch for activating the electronic timing mechanism to begin measuring elapsed time, the switch located inside the housing;

a display for showing the elapsed time, the display visible from outside the housing, the display comprising an elapsed time component and a time scale component, the elapsed time component configured to display numerically how much time has elapsed since the activation of the electronic timer, the time scale component configured to display by at least a word whether the elapsed time is a measure of time in days elapsed or in hours elapsed;

a button for triggering the switch, the button accessible from outside the housing, the button further configured for requesting the display to show the elapsed time in days elapsed or hours elapsed; and a suction cup for directly attaching the electronic timing device to the food container, the suction cup located on the bottom of the housing.

8. The electronic timing device of claim 7 wherein the display for showing elapsed time alternates between showing days elapsed and hours elapsed.

9. The electronic timing device of claim 8 wherein the display for showing elapsed time is a two-digit numerical elapsed time display and an alphanumeric scale display.

10. A method of determining elapsed time since opening a container, the method comprising:

activating a timing function of an electronic timing device attached to the container;

counting elapsed time since activating the timing function of the electronic timing device;

displaying the counted elapsed time in days elapsed on a display of the electronic timing device, the display comprising an elapsed time component and a time scale component, the elapsed time component configured to display numerically how much time has elapsed since the activation of the electronic timer, the time scale component configured to display by at least a word whether the elapsed time is a measure of time in days elapsed or in hours elapsed;

receiving a press of a button on the electronic timing device to request a display of counted elapsed time to switch from days elapsed to hours elapsed; and displaying the counted elapsed time in hours elapsed.

11. The method of claim 10 wherein activating the timing function of the electronic timing device is accomplished by receiving an activation command by a press of the button on the electronic timing device for a predetermined period of time.

12. The method of claim 10 wherein displaying the counted elapsed time in days elapsed further comprises displaying an alphanumeric time scale display.

13. The method of claim 10 wherein displaying counted elapsed time in days elapsed further comprises displaying an operating indicator.

14. The method of claim 10 wherein displaying the counted elapsed time in hours elapsed further comprises displaying an alphanumeric time scale display.

15. A method of determining elapsed time since opening a container, the method comprising:

directly attaching an electronic timing device to a container;

opening the container;

pressing a button on the electronic timing device for a predetermined time to activate a timing function of the electronic timing device thereby causing the timing device to start counting elapsed time;

displaying the counted elapsed time in days elapsed on a display of the electronic timing device, the display comprising an elapsed time component and a time scale component, the elapsed time component configured to display numerically how much time has elapsed since the activation of the timing function of the electronic timing device, the time scale component configured to display with at least one word that the elapsed time is a measure of time in days elapsed;

pressing the button to request the display to show the counted elapsed time in hours elapsed; and displaying the counted elapsed time in hours elapsed on the display, the time scale component configured to display with at least one word that the elapsed time is a measure of time in hours elapsed.

16. The method of claim 15 further comprising:

pressing the button to request the display to show the counted elapsed time in days elapsed; and reading the display of the counted elapsed time in days elapsed.

17. The method of claim 15 wherein directly attaching the electronic timing device to the container is via a suction cup.

18. The method of claim 15 wherein directly attaching the electronic timing device to the container is via a magnet.

19. The method of claim 15 wherein directly attaching the electronic timing device to the container is via hook-and-loop material or adhesive tape.

20. The method of claim 15 wherein opening the container occurs before directly attaching the electronic timing device to the container.

21. The method of claim 15 wherein pressing the button to activate the timing function of the electronic timing device occurs before directly attaching the electronic timing device to the container.

22. The method of claim 15 wherein reading a display of the counted elapsed time in days elapsed further comprises reading a display of a time scale.

23. The method of claim 15 wherein reading a display of the counted elapsed time in days elapsed further comprises reading a display of an operating indicator.

24. The method of claim 15 wherein reading the display of the counted elapsed time in hours elapsed occurs after pressing the button on the electronic timing device for a shorter period of time than the predetermined time to activate the timing function of the electronic timing device.

25. The method of claim 15 wherein displaying counted elapsed time in hours elapsed further comprises displaying an operating indicator.

26. The method of claim 15 wherein reading the display of the counted elapsed time in hours elapsed further comprises reading the display of a time scale.

27. The method of claim 15 wherein reading the display of the counted elapsed time in hours elapsed further comprises reading the display of an operating indicator.

28. The method of claim 15 wherein reading the display of the counted elapsed time in days elapsed occurs after pressing the button on the electronic timing device for a shorter period of time than the predetermined time to activate the timing function of the electronic timing device.

29. An electronic timing device comprising:

an electronic timer;

a switch for activating the electronic timer;

a display for showing elapsed time as determined by the electronic timer, the display comprising an elapsed time component and a time scale component, the elapsed time component configured to display numerically how much time has elapsed since the activation of the electronic timer, the time scale component configured to display by at least a word whether the elapsed time is a measure of time in days elapsed or in hours elapsed;

a button for requesting the display to show the elapsed time in days elapsed or hours elapsed; and a suction cup for directly attaching the electronic timing device to a surface.

30. An electronic timing device comprising:

an electronic timer;

a switch for activating the electronic timer;

a display for showing elapsed time as determined by the electronic timer, the display comprising an elapsed time component and a time scale component, the elapsed time component configured to display numerically how much time has elapsed since the activation of the electronic timer, the time scale component configured to display by at least a word whether the elapsed time is a measure of time in days elapsed or in hours elapsed;

a button for requesting the display to show the elapsed time in one of days elapsed and hours elapsed; and a magnet for directly attaching the electronic timing device to a surface.

31. An electronic timing device for indicating elapsed time, the electronic timing device comprising:

a housing;

an electronic timer for measuring elapsed time, the electronic timer located within the housing;

a switch for activating the electronic timing mechanism to begin measuring elapsed time, the switch located inside the housing;

a display for showing the elapsed time, the display visible from outside the housing, the display comprising an elapsed time component and a time scale component, the elapsed time component configured to display numerically how much time has elapsed since the activation of the electronic timer, the time scale component configured to display by at least a word whether the elapsed time is a measure of time in days elapsed or in hours elapsed;

a button for triggering the switch, the button accessible from outside the housing, the button further configured for requesting the display to show the elapsed time in days elapsed or hours elapsed; and a suction cup for directly attaching the electronic timing device to a surface, the suction cup located on the bottom of the housing.

32. A method of determining elapsed time, the method comprising:

activating a timing function of an electronic timing device attached to a surface;

counting elapsed time since activating the timing function of the electronic timing device;

displaying the counted elapsed time in days elapsed on a display of the electronic timing device, the display comprising an elapsed time component and a time scale component, the elapsed time component configured to display numerically how much time has elapsed since the activation of the electronic timer, the time scale component configured to display by at least a word whether the elapsed time is a measure of time in days elapsed or in hours elapsed;

receiving a press of a button on the electronic timing device to request a display of counted elapsed time to switch from days elapsed to hours elapsed; and displaying the counted elapsed time in hours elapsed.

33. A method of determining elapsed time, the method comprising:

directly attaching an electronic timing device to a surface;

pressing a button on the electronic timing device for a predetermined time to activate a timing function of the electronic timing device thereby causing the timing device to start counting elapsed time;

displaying the counted elapsed time in days elapsed on a display of the electronic timing device, the display comprising an elapsed time component and a time scale component, the elapsed time component configured to display numerically how much time has elapsed since the activation of the timing function of the electronic timing device, the time scale component configured to display with at least one word that the elapsed time is a measure of time in days elapsed;

pressing the button to request the display to show the counted elapsed time in hours elapsed; and displaying the counted elapsed time in hours elapsed on the display, the time scale component configured to display with at least one word that the elapsed time is a measure of time in hours elapsed.

* * * * *